US007736181B1

(12) United States Patent
Benevento et al.

(10) Patent No.: US 7,736,181 B1
(45) Date of Patent: Jun. 15, 2010

(54) COAXIAL CABLE CONNECTOR INTERFACE

(75) Inventors: Vincent J. Benevento, East Haven, CT (US); James W. Nelson, Cheshire, CT (US)

(73) Assignee: Alcatel-Lucent USA Inc., Murray Hill, NJ (US)

( * ) Notice: Subject to any disclaimer, the term of this patent is extended or adjusted under 35 U.S.C. 154(b) by 0 days.

(21) Appl. No.: 12/383,639

(22) Filed: Mar. 26, 2009

(51) Int. Cl.
*H01R 9/05* (2006.01)

(52) U.S. Cl. ..... 439/585

(58) Field of Classification Search ..... 439/274, 439/585, 741, 877–879
See application file for complete search history.

(56) References Cited

U.S. PATENT DOCUMENTS 7,179,122 B2 * 2/2007 Holliday ..... 439/585
7,448,895 B1 * 11/2008 Linan ..... 439/271
7,513,795 B1 * 4/2009 Shaw ..... 439/578
7,566,236 B2 * 7/2009 Malloy et al. ..... 439/321

* cited by examiner

*Primary Examiner*—Khiem Nguyen
(74) *Attorney, Agent, or Firm*—McCormick, Paulding & Huber LLP

(57) ABSTRACT

A coaxial cable connector interface for allowing signals to be transmitted over a coaxial transmission line between devices includes a coaxial cable and a cable connector that allows the coaxial cable to be attached to the devices. The coaxial cable includes a solid outer conductor that has corrugations to increase flexibility of the coaxial cable. The cable connector has a crimp portion that surrounds an end portion of the outer conductor of the coaxial cable. The crimp portion conforms to the corrugations of the outer conductor, thereby creating an interface with the corrugations that attaches the cable connector to the coaxial cable by maintaining an axial load between the cable connector and the coaxial cable. Additionally, the coaxial cable connector interface includes a sealing element and a protective boot for preventing moisture from bridging the interface and causing cable performance reduction.

20 Claims, 5 Drawing Sheets

COAXIAL CABLE CONNECTOR INTERFACE

FIELD OF THE INVENTION

The present invention relates to communication transmission lines and, more particularly, to coaxial transmission lines.

BACKGROUND OF THE INVENTION

Typical coaxial transmission lines include a length of coaxial cable having a cable connector at each end. The cable connectors enable the coaxial transmission line to be connected to various devices, such that the connected devices are able to communicate with one another by transmitting signals and information through the transmission lines.

Many factors affect coaxial transmission line design, such as performance requirements, cable flexibility and material cost. For example, higher quality coaxial transmission lines employ coaxial cable having a solid outer conductor, which provides for improved performance when compared to coaxial cable having other types of outer conductors such as metallic braiding or foil. Solid outer conductors may take various forms, such as smooth or corrugated, wherein corrugated outer conductors are typically preferred because they provide increased cable flexibility when compared to smooth outer conductors. Additionally, corrugated outer conductors may vary in design, some having annular corrugations and others having helical corrugations.

Cable connectors, which allow the coaxial transmission lines to be connected to devices, are typically interfaced with coaxial cables having solid corrugated outer conductors by soldering the connectors to the outer conductors. For example, brass connectors may be soldered to copper or silver outer conductors, producing high quality coaxial transmission cables. Soldering provides for a strong junction between the outer surface and the cable connector, which results in good intermodulation performance, i.e. minimal noise entering the system due to spurious signals. However, while soldering is an adequate method for interfacing some types of solid outer conductors with cable connectors, the flux used to solder the connection is more corrosive to other metals, such as aluminum. This corrosion decreases conductivity in the coaxial transmission line, which decreases intermodulation performance. The decrease is compounded because the flux used in soldering is also very difficult to remove from the assembled cable conductor interface. Therefore, soldering cable connectors to coaxial cables with aluminum outer conductors results in lower quality cables due to the decreased conductivity in the cables, which reduces cable performance and causes cable failure.

Another cause of decreased coaxial cable performance is galvanic corrosion in the cable connector interface, which results from moisture that is able to penetrate the interface and bridge between the outer conductor and the cable connector. Aluminum outer conductors are also more prone to galvanic corrosion than outer conductors made of other metals, such as copper or silver. Galvanic corrosion is also more prevalent in coaxial cables with helical corrugations than annular corrugations because the helical corrugations provide a path for moisture to enter the interface. Thus, as moisture penetrates the cable connector interface and weakens the junction between the outer surface and the cable connector, intermodulation performance further decreases.

In addition to performance considerations of various coaxial transmission line materials, the market cost of materials must also be considered as a factor in the design of coaxial transmission lines. Therefore, there is a need to provide high quality coaxial transmission lines from more materials, including coaxial cables having aluminum outer conductors by overcoming the deficiencies of the prior art.

SUMMARY OF THE INVENTION

According to the present invention, a coaxial cable connector interface includes a coaxial cable having a corrugated solid outer conductor and a cable connector for allowing the coaxial cable to be attached to a device. The cable connector has a crimp portion that surrounds the outer conductor over an end portion of the coaxial cable. The crimp portion conforms to the corrugations of the outer conductor, creating contact points between the crimp portion and the corrugations that maintain the interface between the coaxial cable and the cable connector. The present invention also includes a sealing element and a protective boot for preventing moisture from penetrating the coaxial cable connector interface.

Additionally, according to the present invention, a method for interfacing a coaxial cable having an outer conductor with corrugations and a cable connector includes inserting and end portion of the coaxial cable through a crimp portion of the cable connector, applying an axial force to the coaxial cable to maintain contact with a cable seat of the cable connector, and molding an outer diameter of the crimp portion to conform the crimp portion to the corrugations of the outer conductor of the coaxial cable such that contact between the crimp portion and the outer conductor maintains the axial force acting between the coaxial cable and the cable seat of the cable connector. The method also includes applying a sealing element and a protective boot to the coaxial cable connector interface to prevent moisture from penetrating the interface.

These and other objects, features and advantages of the present invention will become apparent in light of the following detailed description of non-limiting embodiments, with reference to the accompanying drawings.

DETAILED DESCRIPTION OF A PREFERRED EMBODIMENT

Figure 1:
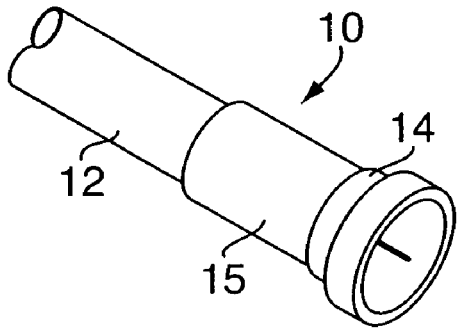
FIG. 1 is a perspective view of a fully assembled coaxial cable connector interface according to an embodiment of the present invention.

Referring to FIG. 1, one end of a coaxial transmission line is shown having a coaxial cable connector interface 10 including a coaxial cable 12 and a cable connector 14. A protective boot 15 covers the coaxial cable connector interface 10 to protect the interface from moisture and to prevent cable kinks at the coaxial cable interface 10.

Figure 2:
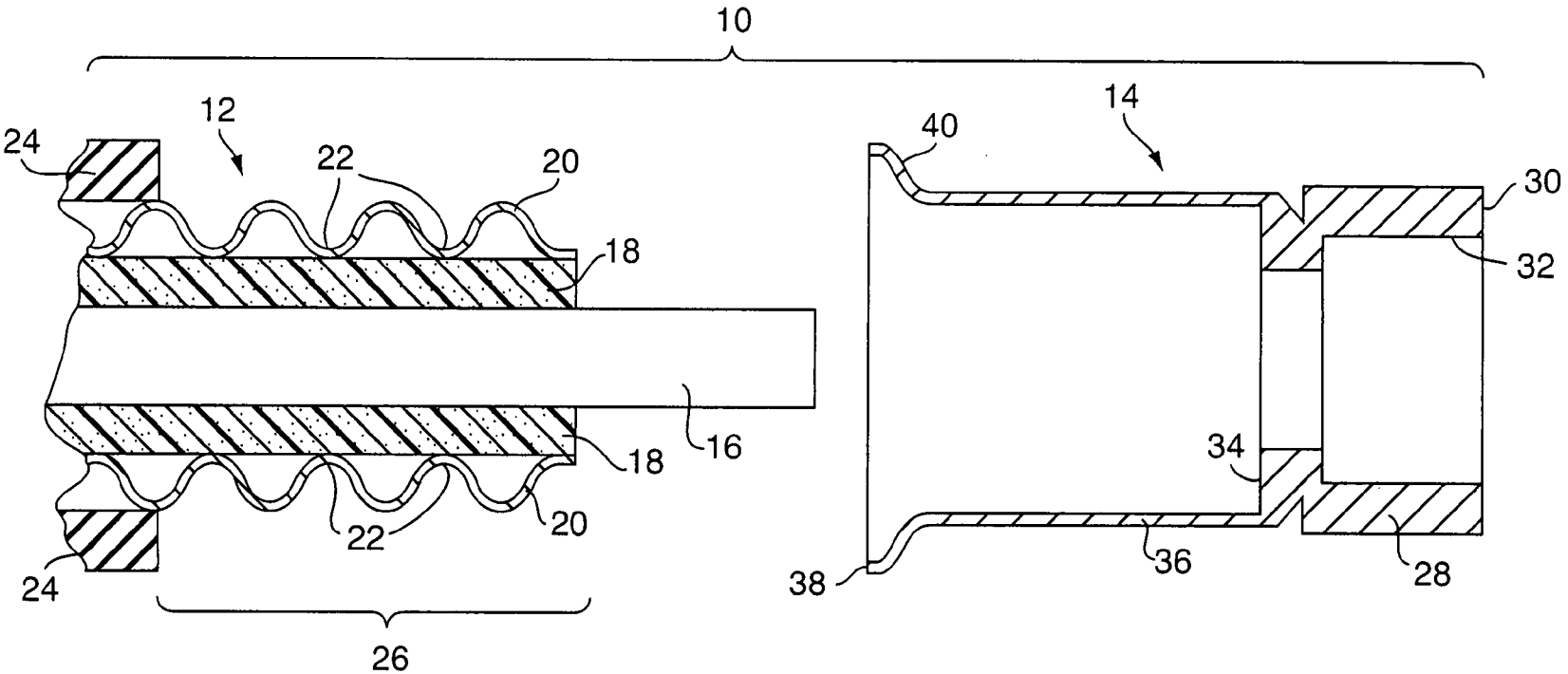
FIG. 2 is a cross-sectional view of a pre-assembled coaxial cable connector interface according to FIG. 1.
Figure 6:
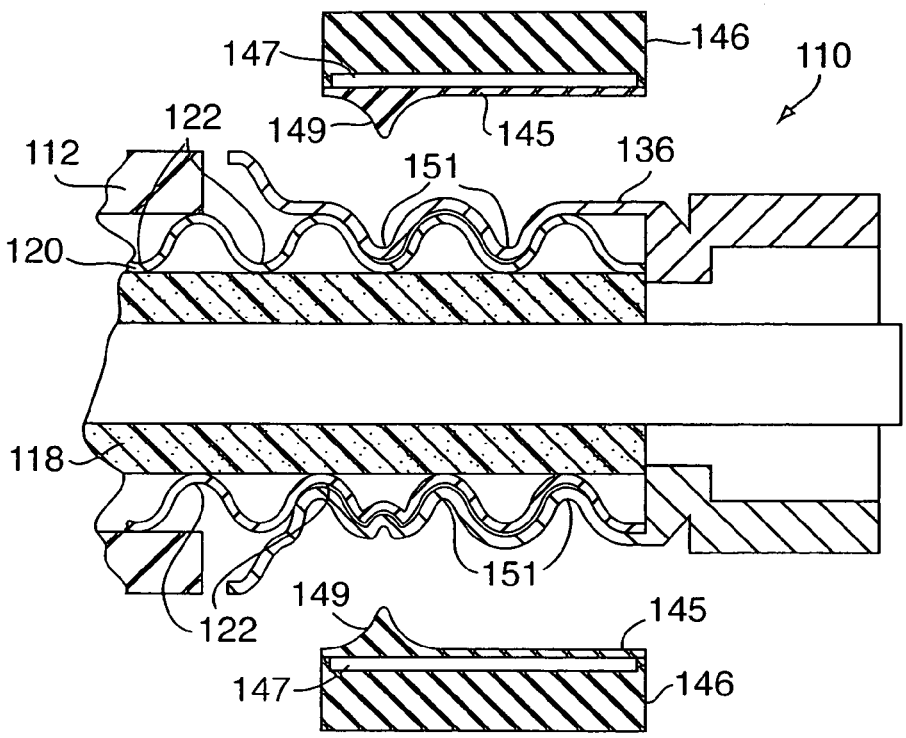
FIG. 6 is a cross-sectional view of another embodiment of the coaxial cable connector interface of FIG. 5.

Referring to FIG. 2, the coaxial cable 12 is a typical annular corrugated coaxial cable and includes a solid center conductor 16. The solid center conductor 16 may be, for example, copper, copper clad aluminum, silver plated copper or any similar center conductor material known in the art. The solid center conductor 16 is surrounded by a dielectric layer 18, which may be polyethylene foam, teflon or another similar dielectric material that provides for a low loss insulator. A solid outer conductor 20 surrounds dielectric layer 18. As discussed above, the solid outer conductor 20 may be selected from a variety of materials; however, the present invention is particularly suited for fabricating high quality coaxial transmission lines having solid aluminum outer conductors. The solid outer conductor 20 includes corrugations 22. Although corrugations 22 are shown as annular corrugations, corrugations 22 may also be helical as seen in FIG. 6. A protective sheath 24 surrounds the outer conductor 22 over the length of the coaxial cable 12, except for an end portion 26 located at each end of the coaxial cable 12. The coaxial cable 12 interfaces with the cable connector 14 at the end portion 26.

The cable connector 14 includes a connector body 28, having a device end 30 that includes a device attachment element 32 to facilitate connection of the transmission line to a communication device (not shown). The device attachment element 32 may take the form of any coaxial cable connector attachment mechanism known in the art and is not germane to the present invention. For example, the device attachment element 32 may include a threaded coupling or a snap-fit coupling. The cable connector 14 may also be fabricated from a variety of materials known in the art, such as brass or silver. Additionally, the cable connector 14 may be plated, for example, gold plated, tin plated or trimetal plated brass wherein the trimetal plating is a combination of tin, copper and zinc. The connector body 28 includes a cable seat 34 opposite the device end 30. Surrounding the cable seat 34 is a thin walled crimp portion 36, which extends outwardly from the cable seat 34 and away from the connector body 28 and terminates at a cable end 38 of the cable connector 14. Prior to assembly of the coaxial cable connector interface 10, the crimp portion 36 is substantially cylindrical and includes a cup-shaped portion 40 at the cable end 38.

Figure 3:
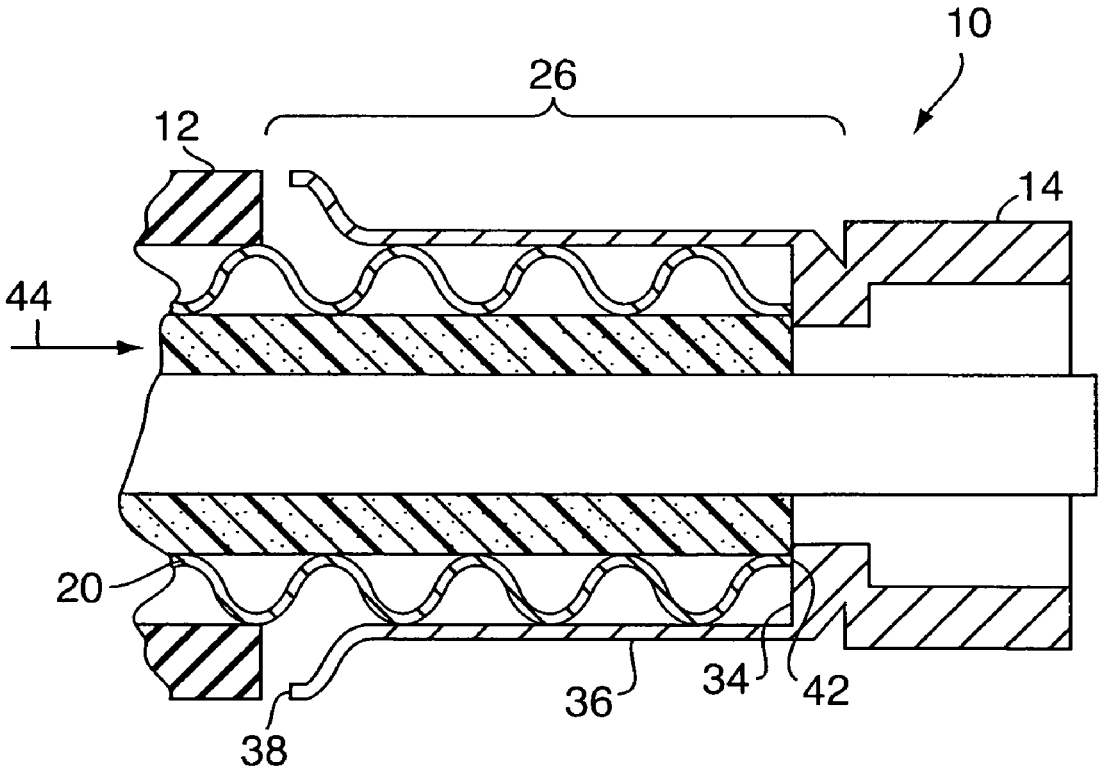
FIG. 3 is cross-sectional view of the coaxial cable connector interface of FIG. 2 prior to molding the crimp portion.

Referring to FIG. 3, during assembly, the end portion 26 of the coaxial cable 12 is inserted into the crimp portion 36 of the cable connector 14 through cable end 38 until an end 42 of the outer conductor 20 abuts the cable seat 34. An axial force 44 is applied to the coaxial cable 12 to preload the contact between the end 42 of the outer conductor 20 and the cable seat 34. The preload should be of sufficient magnitude to ensure that contact is maintained between the outer conductor 20 and the cable seat 34.

Figure 4:
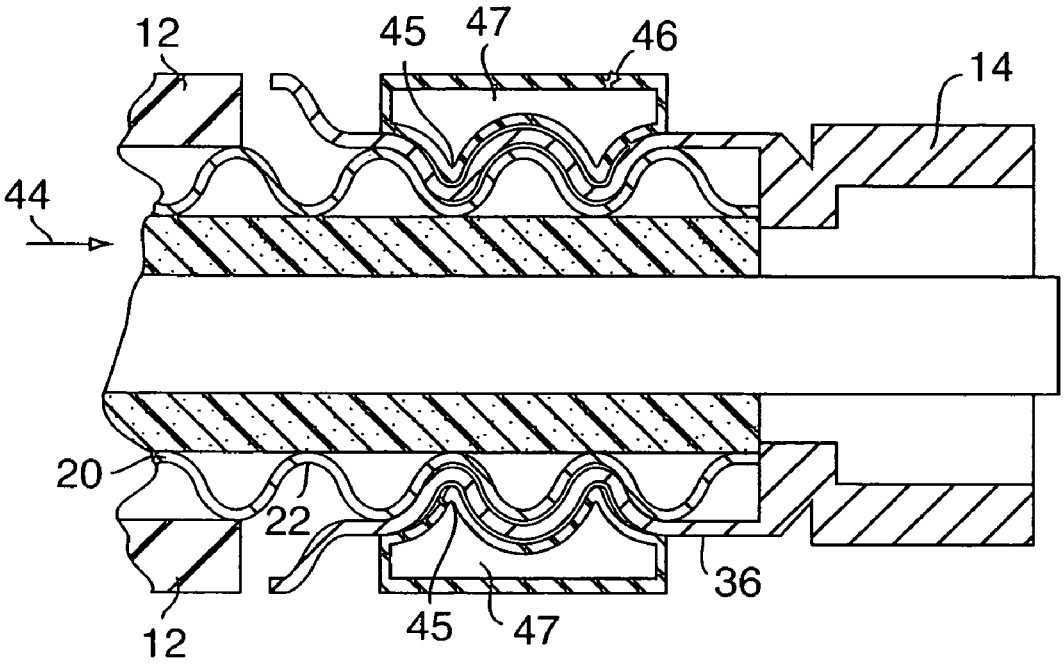
FIG. 4 is a cross-sectional view of the coaxial cable connector interface of FIG. 3 during molding of the crimp portion.

Referring to FIG. 4, while the axial force 44 is still being applied to the coaxial cable 12, the crimp portion 36 is deformed to conform to the corrugations 22 of the outer conductor 20. A crimping tool may be used to deform the crimp portion 36 in a manner similar to hydroforming. For example, the crimping tool 46 has a flexible bladder 45 covering an inflation chamber 47. The flexible bladder 45 may be formed from rubber or a similar flexible rubber-like material. When the inflation chamber 47 is pressurized, the flexible bladder 45 deforms, compressing and deforming the crimp portion 36 to conform to the annular corrugations 22 of the coaxial cable 12. After deforming the crimp portion 36, the axial force 44 can be removed from the coaxial cable 12.

Figure 5:
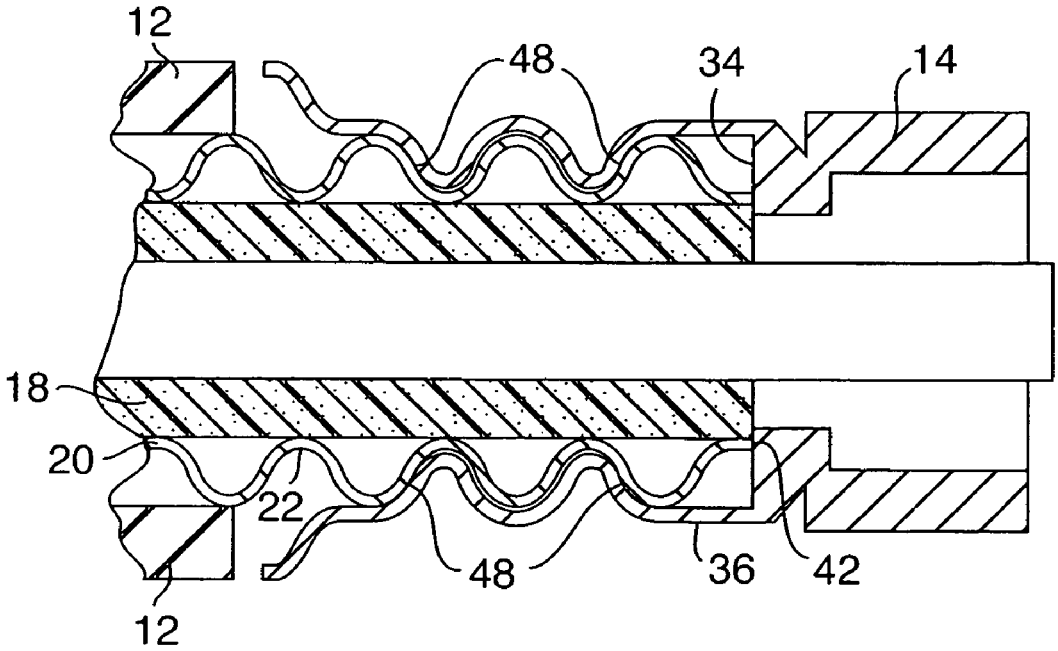
FIG. 5 is a cross-sectional view of the coaxial cable connector interface of FIG. 4 after molding of the crimp portion.

Referring to FIG. 5, the crimp portion 36 remains deformed after the crimping tool 46 has been released. The deformation process produces contact points 48 between the crimp portion 36 and the corrugations 22, which lock the coaxial cable 12 and the cable connector 14 together in the position that the cable was in with the applied axial force 44. Thus, the contact points 48 cause the resultant axial load between the end 42 of the coaxial cable and the cable seat 34 to be maintained, even after the applied axial force 44 is removed. The cable corrugations 22 act as a spring member against the cable interface 34, thereby maintaining the resultant axial load acting between the coaxial cable 12 and the cable connector 14 and ensuring metal to metal contact between the outer conductor 20 and the cable connector 14. The deformation of the crimp portion 36 only causes slight distortions to the dimensions of the coaxial cable 12. For example, in one embodiment, the radially inward deflection of the outer conductor 20, caused by molding the crimp portion 36, is regulated to ensure that the change in the voltage standing wave ration (VSWR) of the coaxial cable 12 does not exceed 1.02, and more preferably, does not exceed 1.015. Change in VSWR is caused by an impedance change due to the deflection of the outer conductor, which results in decreased coaxial transmission line quality. However, the coaxial cable connector interface 10, according to the present invention, is able to tune out a VSWR change of up to 1.02 such that the quality of the coaxial transmission line is not reduced by the coaxial cable connector interface 10. In another embodiment, the deflection of the outer conductor 20 is maintained within the range of 0.007-0.008 inches to minimize the change in VSWR of the coaxial cable. In yet another embodiment, the diameter of the dielectric layer 18 remains substantially undistorted due to molding of the crimp portion 36 to maintain coaxial transmission line quality.

Accordingly, coaxial cable connector interface 10 eliminates the need to solder the cable connector 14 to the outer conductor 20, which in turn eliminates the corrosion caused by the flux used in soldering for coaxial cables having aluminum outer conductors. Thus, coaxial cable connector interface 10 may include coaxial cable 12 with an aluminum outer conductor in high quality cables without decreasing cable intermodulation performance due to corrosion or causing cable failure.

Referring to FIG. 6, wherein like numerals represent like elements, the outer conductor 120 of the coaxial cable 112 includes helical corrugations 122. Assembly of the coaxial conductor interface 110 having helical corrugations 122 is substantially identical to the assembly discussed above in relation to coaxial cable 12 having annular corrugations. However, the crimping tool 146 additionally includes an annular crimping ring 149 on the outer surface of the flexible bladder 145. As discussed above, the flexible bladder 145 covers the inflation chamber 147. When the inflation chamber 147 is pressurized, the flexible bladder 145 deforms, compressing and molding the crimp portion 136. The portion of the flexible bladder 145 without the annular crimping ring 149 on its surface deforms the crimp portion 136 to conform to the helical corrugations 122 of the coaxial cable 112. Additionally, when the flexible bladder 145 deforms, the annular crimping ring 149 is compressed around the crimp portion 136, which forms an annular crimp 151 in the crimp portion 136. The annular crimp 151 deforms a portion of the outer conductor 122 and prevents the coaxial cable 112 from threading out of the cable connector 114. Similar to the embodiment having annular corrugations discussed above, the coaxial cable dimensions are only slightly distorted, such that the change in VSWR is maintained at a level that can be tuned out by the coaxial cable connector interface 10 so that the quality of the coaxial transmission line is not degraded.

Figure 7:
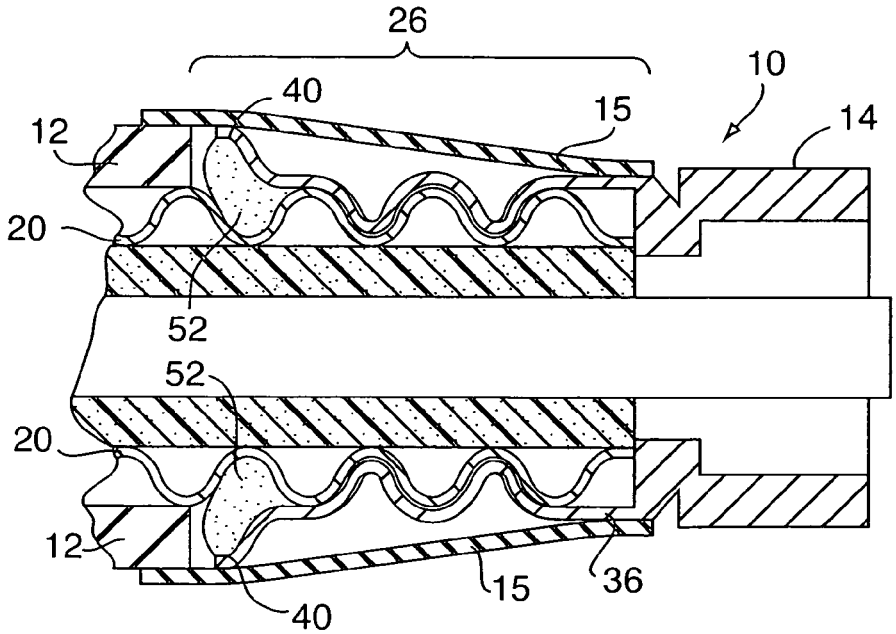
FIG. 7 is a cross-sectional view of the fully assembled coaxial cable connector interface of FIG. 1.

Referring to FIG. 7, a sealing element 52 may be applied to fill the cup-shaped portion 40 of the coaxial cable connector interface 10. For example, sealing element 52 may be fabricated from epoxy or other similar sealing material. Sealing element 52 prevents moisture from penetrating the coaxial cable connector interface 10 and bridging between the outer conductor 20 and the connector 14. Thus, sealing element 52 helps to prevent galvanic corrosion of the coaxial cable connector interface 10, allowing coaxial cables with aluminum outer conductors to be used without resulting in a lower quality cable. Sealing element 52 will also assist in maintaining good intermodulation performance by preventing movement of the coaxial cable 12 inside the crimp portion 36.

After applying sealing element 52 to the coaxial cable connector interface 10, the protective boot 15 is installed to cover the coaxial cable connector interface 10 at least over the length of the end portion 26. The protective boot 15 provides additional moisture protection to the interface as well as prevents cable kinks at the coaxial cable interface 10.

Figure 8:
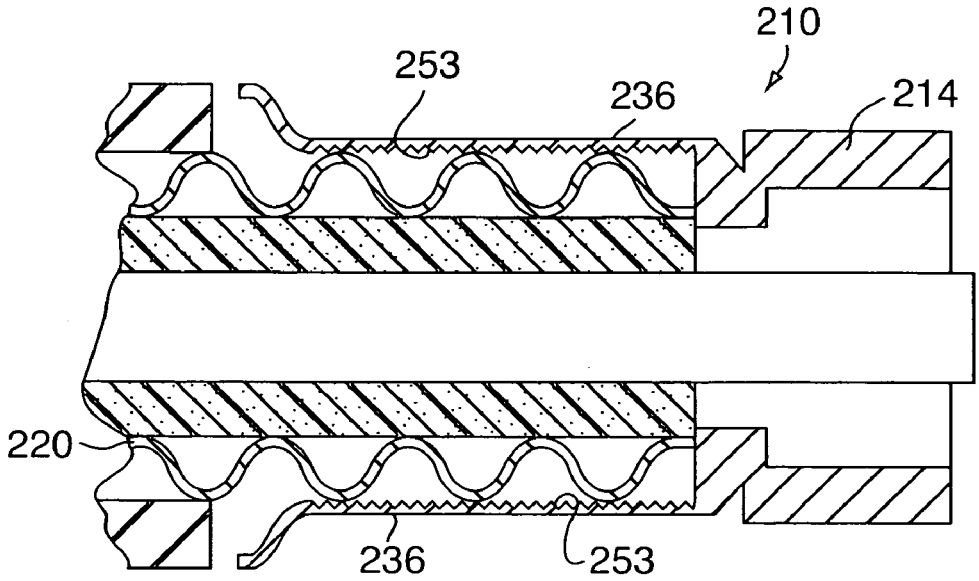
FIG. 8 is a cross-sectional view of another embodiment of the coaxial cable connector interface of FIG. 1 prior to molding the crimp portion.

Referring to FIG. 8, another embodiment of the coaxial cable connector interface 210 includes cable connector 214 that has crimp portion 236, which includes an internal thread 253. Internal thread 253 may be similar to the thread of a standard fastening nut. However, the outer conductor 220 does not threadedly engage the crimp portion 236 during assembly. Rather, outer conductor 220 is axially inserted into the crimp portion 236 in the same manner discussed above in relation to crimp portion 36, which does not include internal thread 253. The crimp portion 236 is then deformed in the same manner discussed above for either annular or helical outer conductors using the appropriate molding tool 46, 146 (not shown).

Figure 9:
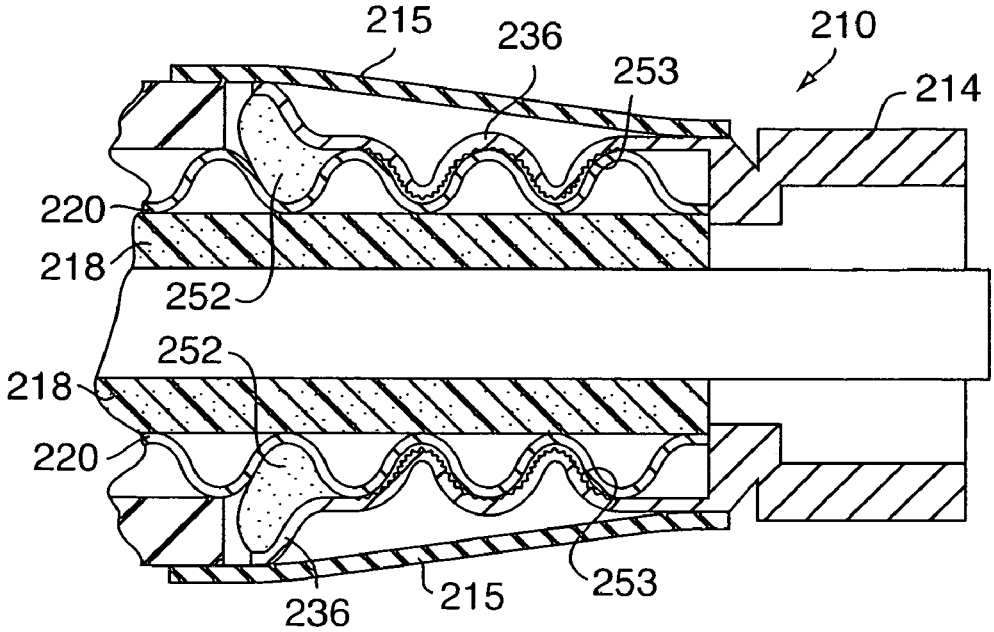
FIG. 9 is a cross-section view of the fully assembled coaxial cable connector interface of FIG. 8.

As seen in FIG. 9, once deformed, the internal thread 253 grips into the outer conductor 220 and provides additional strength to the coaxial cable conductor interface 210. Similar to the embodiments discussed above, the coaxial cable dimensions are only slightly distorted, such that the change in VSWR is maintained at a level that can be tuned out by the coaxial cable connector interface 10 so that the quality of the coaxial transmission line is not degraded. Sealing element 252 and protective boot 215 are then applied in the same manner previously discussed. Although described as being similar to the thread of a standard fastening nut, the internal thread 253 is not limited to a conventional threading, but rather includes any surface that is texturized to increase friction between the crimp portion and the outer conductor.

Accordingly, the present invention provides a coaxial cable connector interface that can be used with coaxial cable made from various conductor materials, including aluminum, without reducing transmission line performance and quality.

Although this invention has been shown and described with respect to the detailed embodiments thereof, it will be understood by those skilled in the art that various changes in form and detail thereof may be made without departing from the spirit and the scope of the invention. For example, although the center conductor 16 is shown as a solid conductor, the center conductor 16 can be of various other configurations known in the art, such as a stranded conductor.

What is claimed is:

1. A coaxial cable connector comprising:

a connector body having a device attachment element at a device end of the connector body to facilitate attachment of the coaxial cable connector to a communication device and a cable seat opposite the device end for contacting an outer conductor of a coaxial cable; and a crimp portion extending from the cable seat of the connector body;

wherein the crimp portion is capable of being deformed to substantially conform to corrugations of the outer conductor of the coaxial cable to maintain an interface with the coaxial cable.

2. The coaxial cable connector according to claim 1, wherein the crimp portion includes a cup-shaped cable end portion.

3. The coaxial cable connector according to claim 1, wherein the crimp portion includes an internal thread.

4. A coaxial cable connector interface comprising:

a coaxial cable having a corrugated solid outer conductor surrounding a dielectric layer; and a cable connector having a crimp portion that surrounds the outer conductor over an end portion of the coaxial cable, the crimp portion substantially conforming to the corrugations of the outer conductor;

wherein contact points between the crimp portion and the corrugations of the outer conductor maintain the interface between the coaxial cable and the cable connector.

5. The coaxial cable connector interface according to claim 4, wherein the contact points maintain a resultant axial load acting between the coaxial cable and a cable seat of the cable connector.

6. The coaxial cable connector interface according to claim 4, wherein the outer conductor is aluminum.

7. The coaxial cable connector interface according to claim 4, wherein the corrugations are annular.

8. The coaxial cable connector interface according to claim 4, wherein the corrugations are helical.

9. The coaxial cable connector interface according to claim 8, additionally comprising an annular crimp wherein the annular crimp deforms a portion of the outer conductor of the coaxial cable to prevent the threading out of the coaxial cable from the cable connector.

10. The coaxial cable connector interface according to claim 4, wherein the crimp portion includes a cable end portion at a cable end of the crimp portion being filled with a sealing element.

11. The coaxial cable connector interface according to claim 10, wherein the cable end portion is cup-shaped.

12. The coaxial cable connector interface according to claim 4, additionally comprising a protective boot, wherein the protective boot covers the coaxial cable connector interface over at least the length of an end portion of the coaxial cable.

13. The coaxial cable connector interface according to claim 4, wherein the crimp portion includes an internal thread that grips the outer conductor.

14. The coaxial cable connector interface according to claim 4, wherein the outer conductor is deflected radially inward not more than 0.008 inches.

15. A method for interfacing a coaxial cable having an outer conductor with corrugations and a cable connector, the method comprising:

inserting an end portion of the coaxial cable through a crimp portion of the cable connector;

applying an axial force to the coaxial cable to maintain contact between the coaxial cable and a cable seat of the cable connector; and deforming an outer diameter of the crimp portion to substantially conform the crimp portion to the corrugations of the outer conductor of the coaxial cable such that contact between the crimp portion and the outer conductor maintains a resultant axial load between the coaxial cable and the cable connector.

16. The method according to claim 15, wherein deforming the outer diameter of the crimp portion includes deforming an annular crimp that deforms a portion of the outer conductor to prevent the threading out of the coaxial cable from the cable connector.

17. The method according to claim 15, additionally comprising filling a cup-shaped portion at a cable end of the crimp portion with a sealing element.

18. The method according to claim 15, additionally comprising covering the coaxial cable connector interface with a protective boot over at least the length of the end portion of the coaxial cable.

19. The method according to claim 15, wherein deforming the outer diameter of the crimp portion causes a change in VSWR of the coaxial cable of less than 1.02.

20. The method according to claim 15, wherein deforming the outer diameter of the crimp portion causes a change in VSWR of the coaxial cable of less than 1.015.

* * * * *